US006974064B1

(12) United States Patent
Chou

(10) Patent No.: US 6,974,064 B1
(45) Date of Patent: Dec. 13, 2005

(54) DEVICE FOR DISCHARGING A NAIL BY THE FORCE OF AN EXPLOSIVE

(75) Inventor: Chien-Chi Chou, Chang Hua Hsien (TW)

(73) Assignee: Yong Song Hardware & Tool Co., Ltd., Pitou Hsiang (TW)

( * ) Notice: Subject to any disclaimer, the term of this patent is extended or adjusted under 35 U.S.C. 154(b) by 95 days.

(21) Appl. No.: 10/727,955

(22) Filed: Dec. 5, 2003

(51) Int. Cl.[7] ..... B25C 1/14
(52) U.S. Cl. ..... 227/10; 227/9; 227/130; 227/136; 227/138; 89/1.14
(58) Field of Search ..... 227/10, 9, 130, 227/136, 138; 89/1.14

(56) References Cited

U.S. PATENT DOCUMENTS 3,499,590 A * 3/1970 Wolfgang et al. ..... 227/10
4,074,843 A * 2/1978 Oesterle ..... 227/8
4,114,792 A * 9/1978 Pomeroy ..... 227/8
4,267,952 A * 5/1981 Kershner ..... 227/9
4,375,269 A * 3/1983 Bosch et al. ..... 227/8
4,804,127 A * 2/1989 Kirkman ..... 227/10
5,518,161 A * 5/1996 Thompson ..... 227/8
5,829,661 A * 11/1998 Hirtl et al. ..... 227/10
6,272,782 B1 * 8/2001 Dittrich et al. ..... 42/6

* cited by examiner

*Primary Examiner*—Rinaldi I. Rada
*Assistant Examiner*—Michelle Lopez
(74) *Attorney, Agent, or Firm*—Alan D. Kamrath; Nikolai & Mersereau, P.A.

(57) ABSTRACT

A nail gun includes a body which is provided with an upright slot and a horizontal slot. The upright slot is used to accommodate an explosive array while the horizontal slot is used to disposed a trigger mechanism for discharging nails by the force of the explosive array. The trigger mechanism has a link rod, an actuation rod, a nail firing tube, and a recovery spring. The link rod is triggered by the nail firing tube in motion to bring about the stretching of the recovery spring and the swiveling of the actuation rod such that a retaining hook of the actuation rod is retained in one of a series of retaining slots of the explosive array. The explosive array is forced to move upward by the retaining hook of the actuation rod at such time when the link rod is relieved of the pressure of the nail firing tube.

1 Claim, 8 Drawing Sheets

DEVICE FOR DISCHARGING A NAIL BY THE FORCE OF AN EXPLOSIVE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a nail gun, and more particularly to a nail gun by which a nail is discharged by the force of an explosive for the purpose of fastening pieces or parts together.

BACKGROUND OF THE INVENTION

As shown in FIGS. 5–8, a prior art nail gun comprises a body 60, which is provided with an upright slot 62 to accommodate an explosive array 61 in such a manner that the explosive array 61 can be caused to move up and down along the upright slot 62 by a cooperative effort of a movable arm 63, a link rod 64 and an actuation rod 65. The movable arm 63 is pivoted at a pivoting point 66 with a barrel 67 and is provided with a nail loading hole 68. As the movable arm 63 is swivelled forward for an angle of 180 degrees, the movable arm 63 is aligned with the barrel 67 so as to enable the nail to be loaded in the barrel 67 by means of a slide seat 69 which is pivoted with the movable arm 63. The link rod 64 and the actuation rod 64 are disposed in a horizontal chamber 70 such that the link rod 64 is pivoted with the movable arm 63, and that an inverted hook 652 of the actuation rod 65 is retained in one of the retaining slots 611 of the explosive array 61. The actuation rod 65 is provided with a V-shaped through hole 653 in which a pin of the link rod 64 is movable received. Each time when a nail is discharged, the movable arm 63 must be swivelled forward and backward, so as to complete the loading of another nail and to position another explosive cavity 612 of the explosive array 61. It is therefore readily apparent that the prior art nail gun is inefficient at best.

BRIEF SUMMARY OF THE INVENTION

The primary objective of the present invention is to provide a nail gun which is free of the deficiencies of the prior art nail gun described above.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
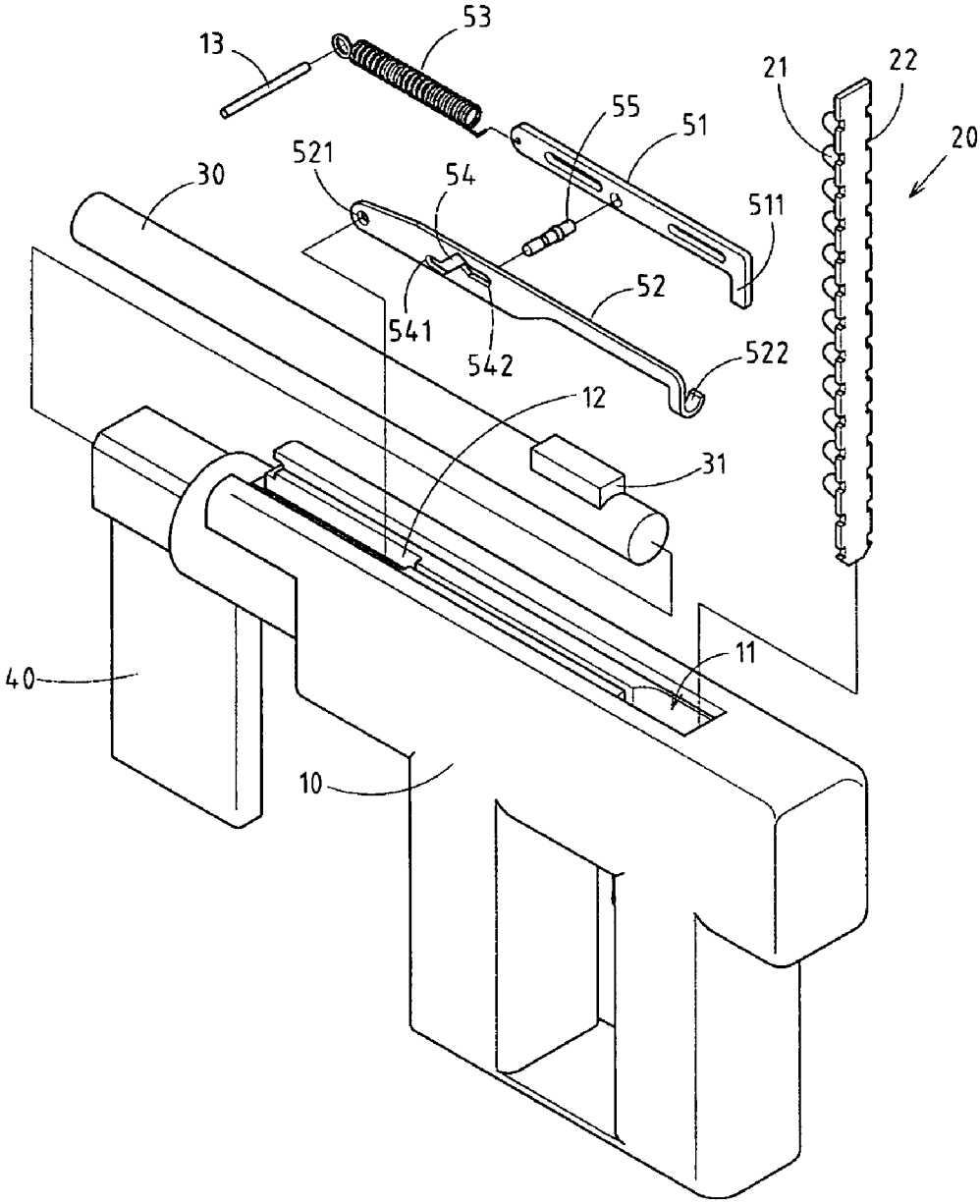
FIG. 1 shows an exploded perspective view of the preferred embodiment of the present invention.
Figure 2:
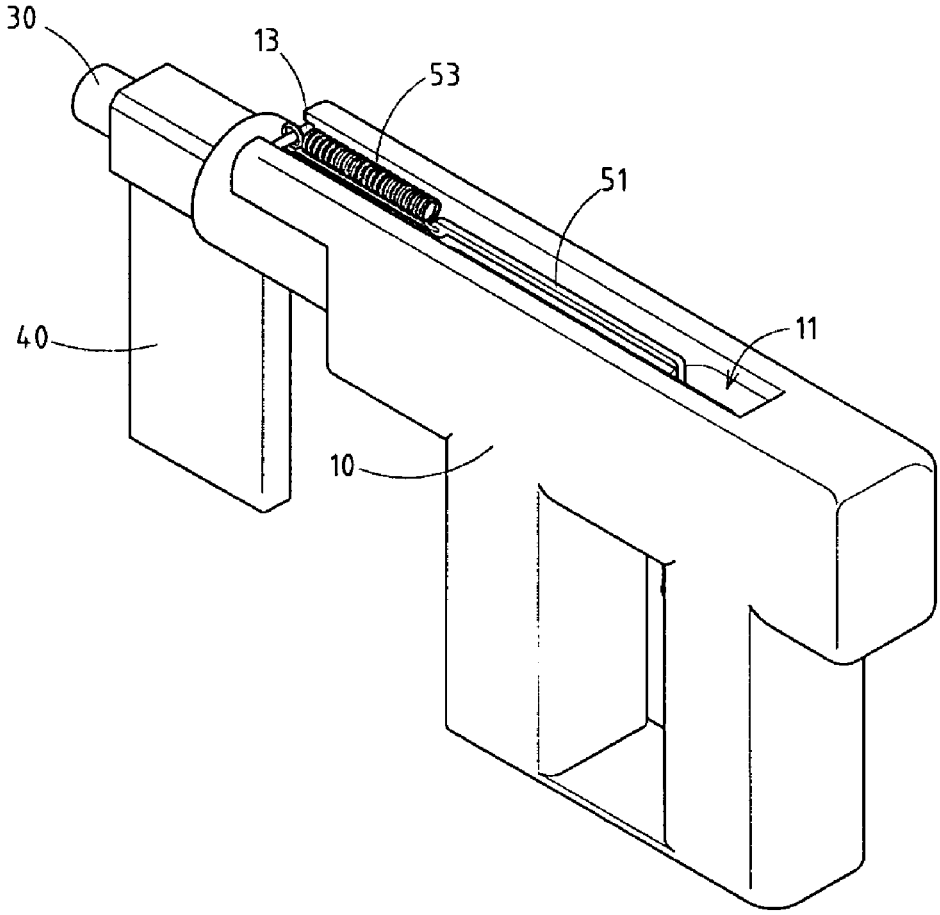
FIG. 2 shows a perspective view of the preferred embodiment of the present invention.

As shown in FIGS. 1–4, a nail gun embodied in the present invention comprises a body 10, which is provided with an upright slot 11 to accommodate an explosive array 20. The explosive array 20 is capable of moving up and down along the upright slot 11 and is formed of a plurality of explosive cavities 21 arranged at intervals, and a plurality of retaining slots 22 arranged at intervals. The body 10 is provided with a nail firing tube 30, and a nail magazine 40 connected to the nail firing tube 30.

The body 10 is further provided with a horizontal slot 12 perpendicular to and in communication with the upright slot 11. The horizontal slot 12 is used to dispose a link rod 51, an actuation rod 52, and a recovery spring 53. The link rod 51 is provided with a contact portion 511, which comes in contact with a contact surface 31 of the nail firing tube 30, thereby enabling the link rod 51 to move along with the nail firing tube 30. The recovery spring 53 is retained between one end of the link rod 51 and a fixation pin 13 of the body 10. The recovery spring 53 serves to provide the link rod 51 with a recovery force. The actuation rod 52 is pivoted at a pivoting point 521 in the horizontal slot 12 such that a retaining hook 522 of the actuation rod 52 is retained in one of the retaining slots 22 of the explosive array 20. The actuation rod 52 is provided in the midsegment with a V-shaped guide hole 54 which has a front end 541, and a rear end 542 located at a higher level than the front end 541. Located between the link rod 51 and the actuation rod 52 is a pin 55, which is movably received in the guide hole 54.

Figure 3:
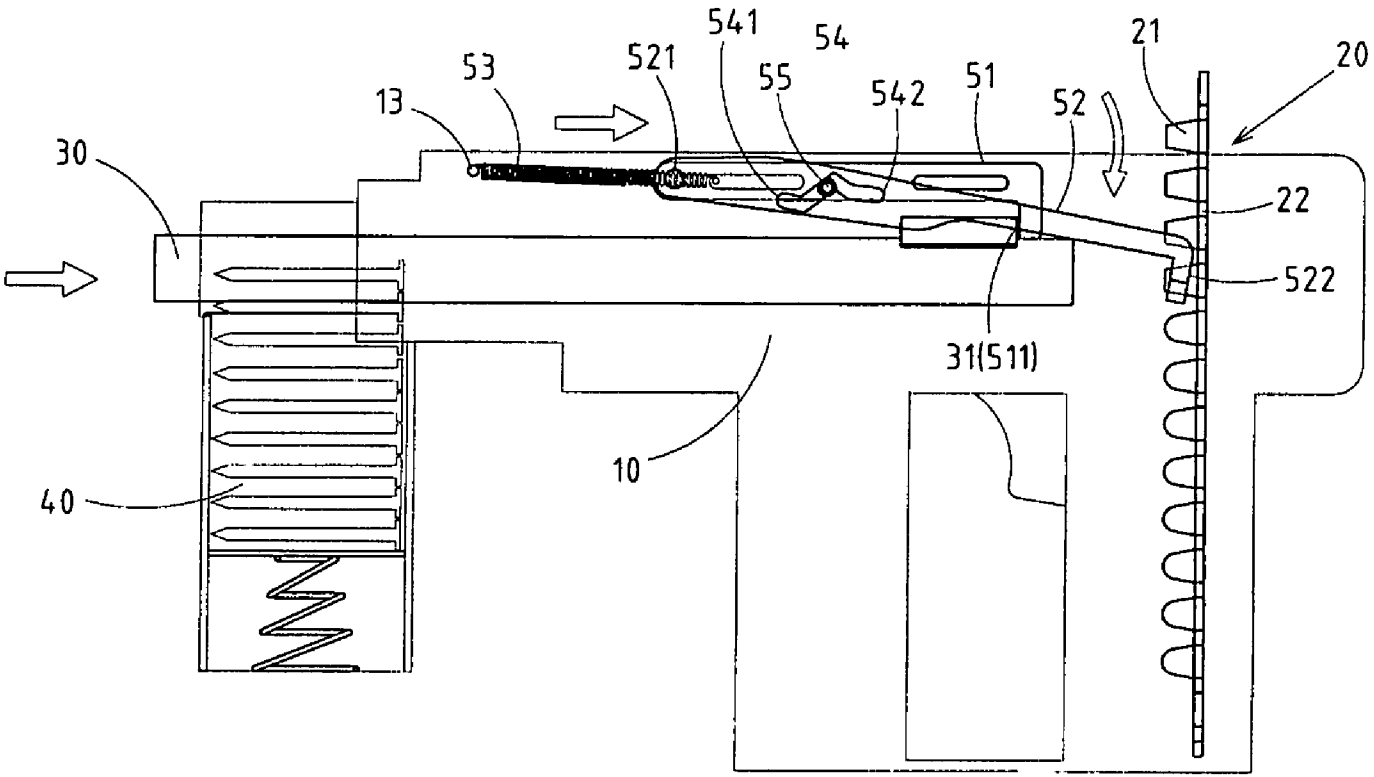
FIG. 3 shows a sectional schematic view of the preferred embodiment of the present invention at work.

As illustrated in FIG. 3, the nail firing tube 30 is forced to move inward by pressing the nail firing tube 30 against an object or wall. Meanwhile, the link rod 51 is moved inward to stretch the recovery spring 53. The pin 55 moves toward the rear end 542 of the guide hole 54. As a result, the actuation rod 52 swivels on the pivoting point 521 thereof such that the retaining hook 522 of the actuation rod 52 is retained in another one of the retaining slots 22 of the explosive array 20.

Figure 4:
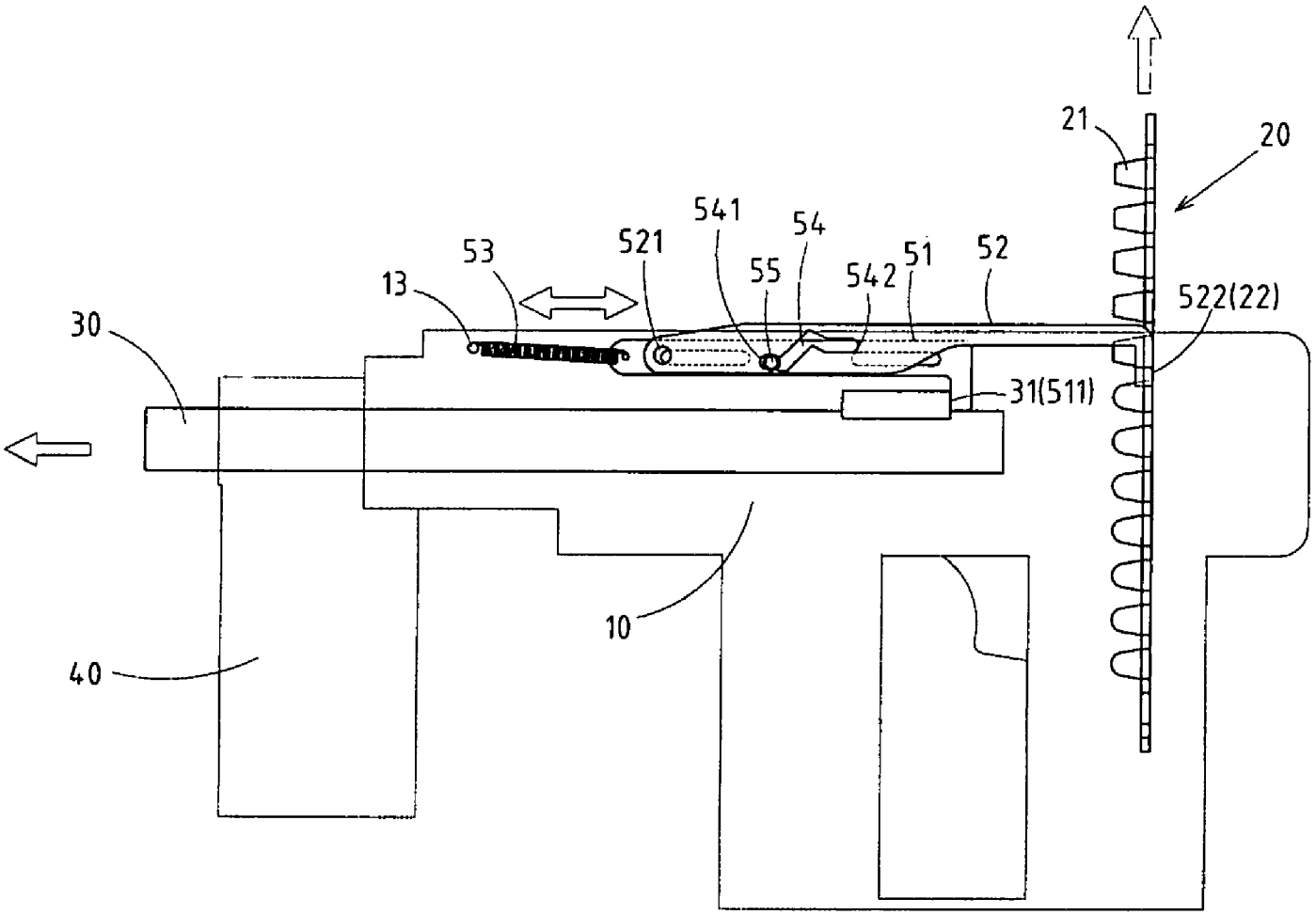
FIG. 4 shows another sectional schematic view of the preferred embodiment of the present invention at work.
Figure 5:
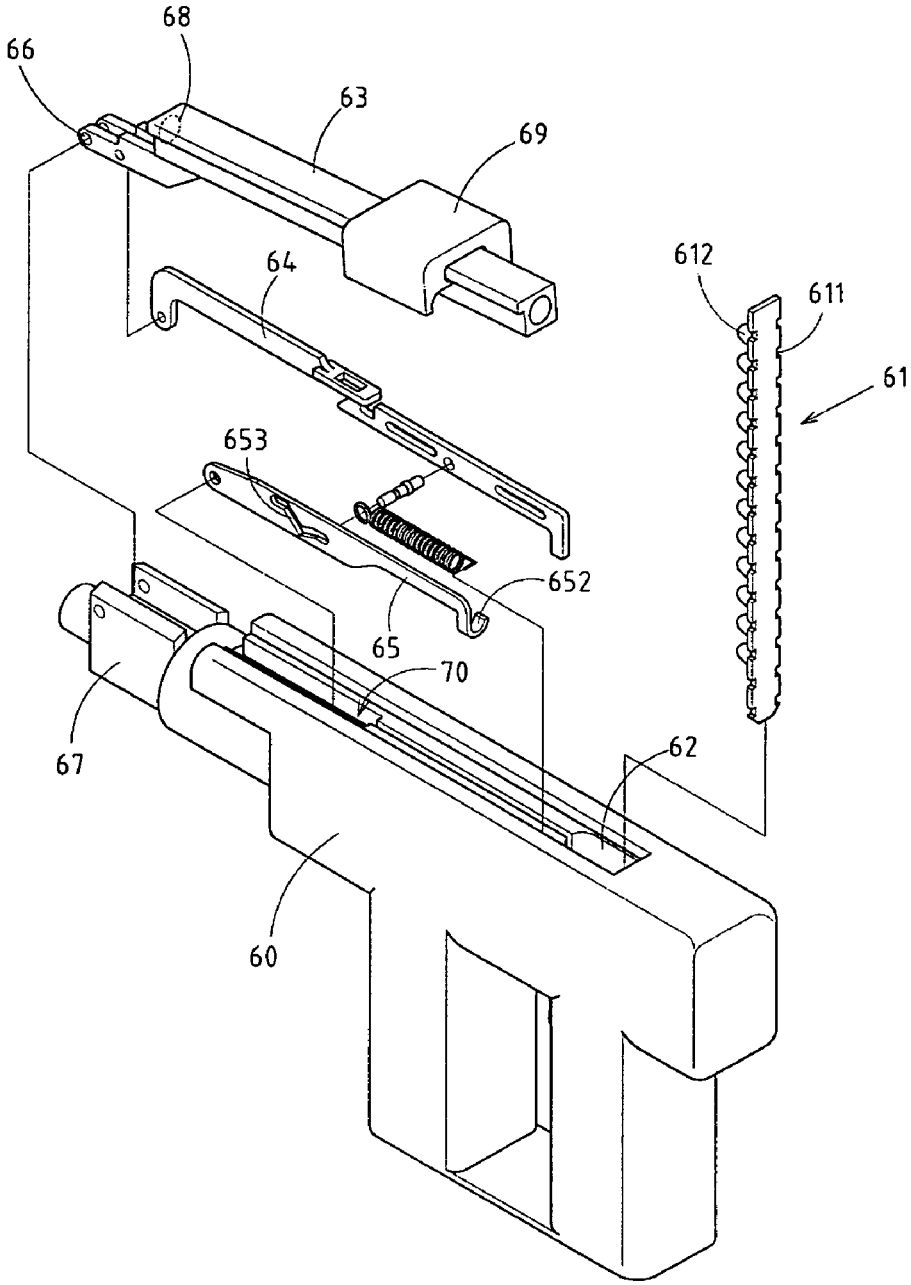
FIG.5 PRIOR ART
FIG. 5 shows an exploded perspective view of a prior art nail gun.
Figure 6:
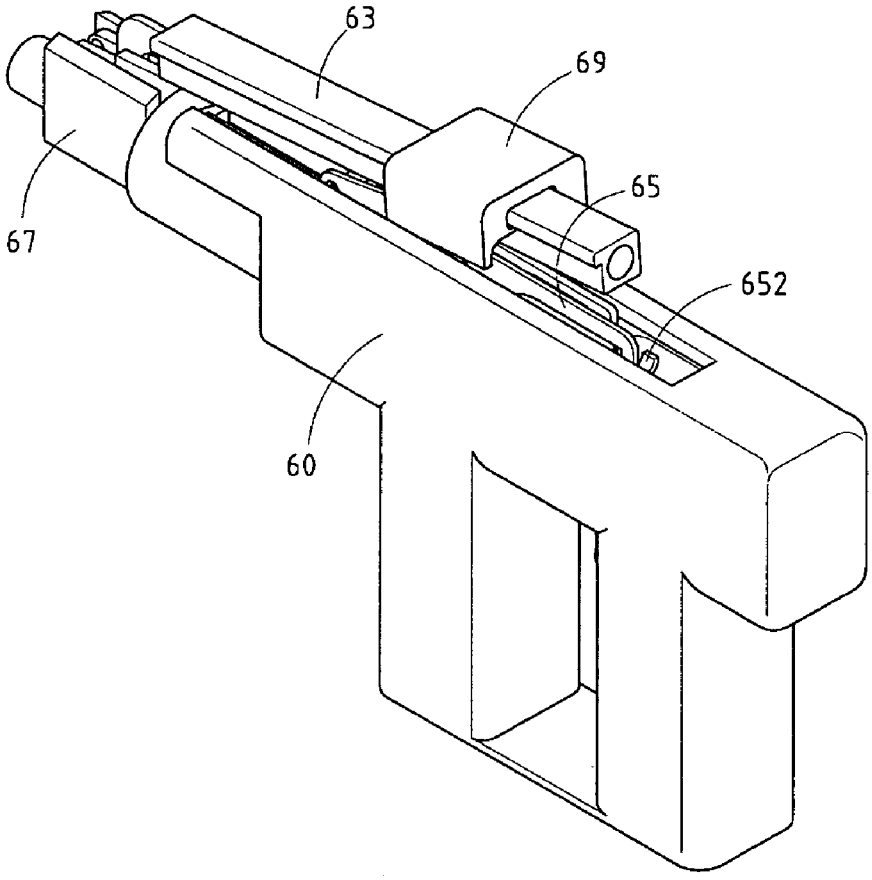
FIG.6 PRIOR ART
FIG. 6 shows a perspective view of the prior art nail gun.
Figure 7:
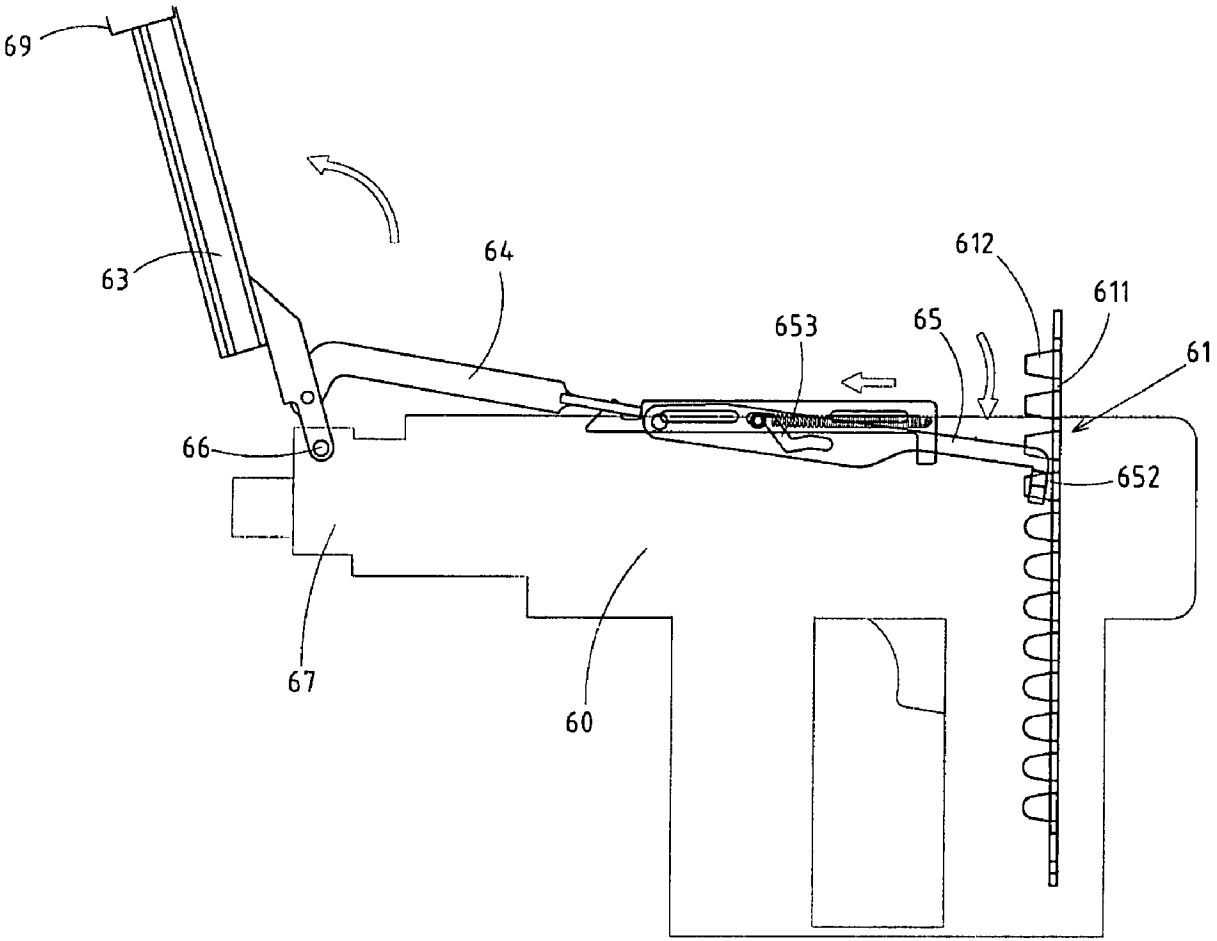
FIG. 7 PRIOR ART
FIG. 7 shows a sectional schematic view of the prior art nail gun at work.
Figure 8:
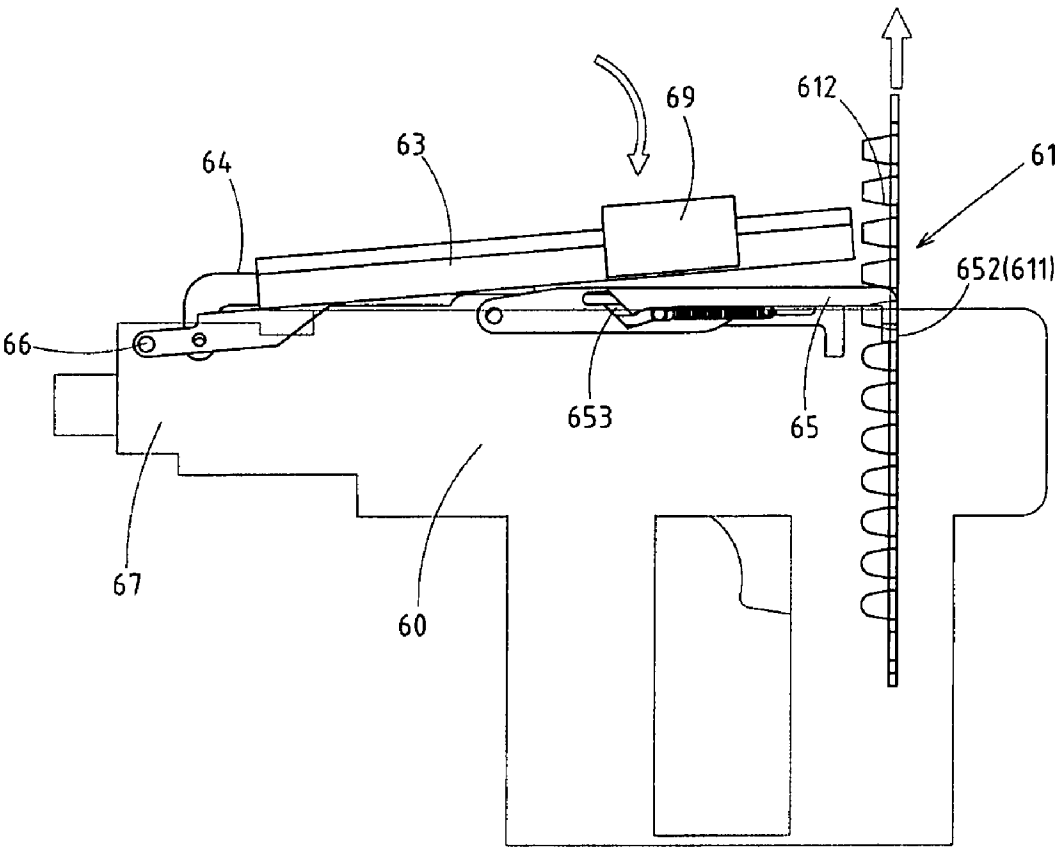
FIG.8 PRIOR ART
FIG. 8 shows another sectional schematic view of the prior art nail gun at work.

As illustrated in FIG. 4, when the nail firing tube 30 is relieved of the pressure, the link rod 51 is caused by the recovery force of the recovery spring 53 to return to its original position. Meanwhile, the pin 55 moves back to the front end 541 of the guide hole 54. The retaining hook 522 of the actuation rod 52 moves upward, thereby resulting in an upward movement of the explosive array 20.

The nail gun of the present invention is provided with a simple and efficient trigger mechanism. In another words, the firing of a nail by the nail gun of the present invention is attained simply by pressing the front end of the nail firing tube 30 against an object or wall, and then by moving the front end of the nail firing tube 30 away from the object or wall.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

What is claimed is:

1. A nail gun comprising:

a body comprised of an upright slot and a horizontal slot perpendicular to and in communication with said upright slot;

an explosive array comprised of a series of explosive cavities and retaining slots, said explosive array being movably located in said upright slot of said body;

a nail magazine fastened to one end of said body; and a trigger mechanism located in said horizontal slot of said body and connected with said nail magazine, said trigger mechanism serving to discharge nails kept in said nail magazine by the force of said explosive array;

wherein said trigger mechanism comprises:

a nail firing tube connected at one end with said nail magazine and provided at another end with a contact surface whereby said nail firing tube is movably located in said horizontal slot of said body;

a link rod provided with a contact portion which comes in contact with said contact surface of said nail firing tube;

an actuation rod pivoted at one end in said horizontal slot and provided at another end with a retaining hook engageable with one of said retaining slots of said explosive array, said actuation rod further comprised of a guide hole for receiving one end of a pin whereby said pin is extended from said link rod; and a recovery spring fastened at one end with a fixation point of said body, and at other end with one end of said link rod;

wherein said contact portion of said link rod is pushed by said contact surface of said nail firing tube at the time when the one end of said nail firing tube is pressed against an object or wall, so as to cause said nail firing tube to displace, thereby resulting in the stretching of said recovery spring and the moving of the one end of said pin of said link rod from a front end of said guide hole to a rear end of said guide hole so as to cause said actuation rod to swivel on the one end thereof such that said retaining hook of the other end of said actuation rod is retained in one of the series of said retaining slots of said explosive array whereby said link rod is caused by a recovery force of said recovery spring to return to an original position thereof at the time when the one end of said nail firing tube is moved away from the object or wall, thereby resulting in the moving of the one end of said pin form the rear end of said guide hole to the front end of said guide hole so as to cause said retaining hook of the other end of said actuation rod to move in an upward direction to bring about an upward movement of said explosive array along said upright slot of said body.

* * * * *